US005122713A

United States Patent [19]

Liang et al.

[11] Patent Number: 5,122,713

[45] Date of Patent: Jun. 16, 1992

[54] ATMOSPHERIC PRESSURE CAPACITIVELY COUPLED PLASMA EXCITATION SOURCE

[75] Inventors: Dong C. Liang, Vancouver; Michael W. Blades, Surrey, both of Canada

[73] Assignee: University of British Columbia, Vancouver, Canada

[21] Appl. No.: 713,570

[22] Filed: Jun. 11, 1991

Related U.S. Application Data

[63] Continuation of Ser. No. 354,511, May 19, 1989, abandoned.

[51] Int. Cl.[5] ..... H05H 1/24

[52] U.S. Cl. ..... 315/111.21; 356/312; 356/316; 313/231.31; 250/425

[58] Field of Search ..... 356/311, 312. 316; 315/111.21; 313/231.31; 250/425

[56] References Cited

U.S. PATENT DOCUMENTS

| | | | |
|---|---|---|---|
| 3,739,067 | 6/1973 | Stahr et al. | 356/316 X |
| 4,095,142 | 6/1978 | Murayama et al. | 356/316 X |
| 4,223,048 | 9/1980 | Engle, Jr. | 427/39 X |
| 4,479,075 | 10/1984 | Elliott | 356/316 X |
| 4,766,351 | 8/1988 | Hull et al. | 313/231.31 X |
| 4,795,880 | 1/1989 | Hayes et al. | 315/111.51 X |
| 4,824,241 | 4/1989 | Littlejohn et al. | 356/312 X |
| 4,826,318 | 5/1989 | Guenther et al. | 356/312 |
| 4,895,443 | 1/1990 | de Loos-Vollebregt et al. | 356/312 X |

FOREIGN PATENT DOCUMENTS 0263031 4/1988 European Pat. Off. .
2071314 9/1981 United Kingdom .

OTHER PUBLICATIONS

W. Slavin, "Trends in Analytical Chemistry", 6, 194 (1987).
D. Littlejohn and J. M. Ottaway, Analyst 104, 208 (1979).
H. Falk, E. Hofmann, I. Jaeckel and Ch. Ludke, Spectrochim. Acta 34B, 333 (1979).
H. Falk, E. Hoffmann and Ch. Ludke, Spectrochim. Acta 36B, 767 (1981).
J. M. Harnley, D. L. Styris and N. E. Ballou, Abstracts, The Pittsburg Conference & Exposition, Paper No. 847 (1989).

*Primary Examiner*—Eugene R. Laroche
*Assistant Examiner*—D. Hyum Yoo
*Attorney, Agent, or Firm*—Barrigar & Oyen

[57] ABSTRACT

This invention pertains to an atmospheric pressure capacitively coupled plasma formed inside a graphite furnace as a source for atomic emission spectroscopy. A capacitively coupled plasma device includes an electrically conducting, hollow elongated tube and an electrically conducting rod located coaxially and substantially inside the elongated tube, an ionizable gas present inside the cylindrical tube, and a mechanism of applying a high-frequency electric potential between the tube and the rod.

24 Claims, 2 Drawing Sheets

ATMOSPHERIC PRESSURE CAPACITIVELY COUPLED PLASMA EXCITATION SOURCE

CROSS-REFERENCE TO RELATED APPLICATIONS

This is a continuation of application Ser. No. 07/354,511, filed May 19, 1989, abandoned.

CROSS REFERENCE

The patent application entitled "A Capacitively Coupled Plasma Detector for Gas Chromatography" filed on May 19, 1989, assigned Ser. No. 07/354,150, in the names of the same inventors as this application discloses subject matter common to this application.

FIELD OF THE INVENTION

This invention pertains to an atmospheric pressure capacitively coupled plasma formed inside a graphite furnace as a source for atomic emission spectroscopy.

BACKGROUND OF THE INVENTION

For many years, graphite furnace atomic absorption spectrometry (GFAAS) has been recognized as one of the most sensitive analytical techniques for elemental analysis, see W. Slavin, Trends in Analytical Chemistry, 6, 194 (1987). GFAAS sensitivity is primarily due to the high efficiency of analyte transport into the observation volume and the relatively long residence time of the analyte in this volume. It has been found that both temporal and spatial isothermal atomization are required in order to control the effects of gas phase interferences. The use of stabilized temperature platform furnaces (STPF), capacitive current heating, probe insertion, and constant temperature furnaces have made the GFAAS capable of trace element determinations for an increasing variety of complex samples. In spite of these advances, chemical interferences continue to limit the effectiveness of GFAAS and, more importantly, the method is essentially a single element technique.

In the past, several approaches have been used to enhance the graphite furnace as a multielement source for atomic emission spectrometry (AES). D. Littlejohn and J. M. Ottaway, Analyst 104, 208 (1979) have described carbon furnace atomic emission spectrometry (CFAES) which is a sensitive technique for trace analysis using thermal excitation from normal furnace heating. This method is limited by the maximum temperature of the graphite furnace and is not very suitable for elements with high excitation energies.

Falk and his co-workers in H. Falk, E. Hofmann, I. Jaeckel and Ch. Ludke, Spectrochim. Acta 34B, 333 (1979) and H. Falk, E. Hoffmann, and Ch. Ludke, Spectrochim. Acta 36B, 767 (1981), developed a low pressure glow discharge inside the graphite furnace. This technique has been termed FANES (Furnace Atomization Non-thermal Excitation Source). Detection limits for FANES are generally similar or superior to those of GFAAS. The technique is attractive due to its large linear dynamic range, narrow atomic linewidth, multielement capability, and because there is the possibility for independent optimization of atomization and excitation.

Recently, Harnley et al. in J. M. Harnley, D. L. Styris and N. E. Ballou, Abstracts, The Pittsburg Conference & Exposition, Paper No. 847 (1989) have described a similar device in which the graphite furnace serves as an anode of a glow discharge where the cathode is a graphite pin which runs down the centre of the furnace. This design is more flexible in terms of the electrical isolation requirements. This device has been used as an atomic emission source for the analysis of metals and nonmetals. Both of the latter sources are essentially low pressure, direct current (dc) glow discharges. In a glow discharge the gas temperature is low (not in local thermal equilibrium), the residence time of analyte atoms is relatively short, analyte density in the gas phase is low, and perhaps most important from an analytical standpoint, it is not convenient to change samples at low pressure.

SUMMARY OF THE INVENTION

The invention pertains to an apparatus for generating an atmospheric pressure radio-frequency capacitively coupled plasma which in combination comprises: (a) an electro-thermal atomizer which generates a sample vapour; and (b) a radio frequency plasma discharge means located in the interior of the atomizer.

The electro-thermal atomizer can be a furnace constructed of graphite or metal. The furnace can be graphite and can be heated by a graphite furnace atomizer power supply.

The radio frequency discharge means can be operated at atmospheric pressure. It can be a radio frequency electrode, which derives power from a radio frequency power supply. An impedance matcher connects the radio frequency power supply and the radio frequency electrode. The furnace can be operated by a furnace supply power which can be connected to the furnace by a radio frequency filter. The furnace can be a graphite tube and the radio frequency electrode can be an electrically conducting rod such as a graphite or tungsten rod inserted into the interior of the furnace tube. The apparatus can include a mechanism for atmospheric pressure radio frequency sputtering.

In another aspect, the invention pertains to a method of generating an atmospheric pressure radio-frequency capacitively coupled plasma which comprises generating a plasma in an electro-thermal atomizer and exciting the plasma with a radio frequency discharge at atmospheric pressure.

The invention is also directed to a method of exciting atomic species in the gas phase which comprises placing the species in a capacitively coupled plasma generated in an electro-thermal atomizer and subjecting the plasma to a radio frequency discharge. The discharge can be at atmospheric pressure.

DRAWINGS

In drawings which illustrate specific embodiments of the invention but which should not be construed as restricting the spirit or scope of the invention in any way:

FIG. 1 is a schematic diagram of the Atmospheric Pressure Furnace Capacitively Coupled Plasma (APF-CCP) source;

FIGS. 2*a* and 2*b* are respective plots of spectra of copper and zinc between 322 and 338 nm from the APF-CCP source;

FIG. 3 is a plot of a comparison of intensity of Zn I 334.50 nm from (a) APF-CCP source at a dark red furnace temperature (approximately 800° C.); (b) CFAES at the same furnace temperature as in (a); (c) Same as (b) except running at maximum furnace temperature (approximately 2800° C.); and FIG. 4 is an emission intensity of Cu I 324.75 nm as a function of the plasma support gas flow rate.

DETAILED DESCRIPTION OF SPECIFIC EMBODIMENTS OF THE INVENTION

An atmospheric pressure radio-frequency (rf) capacitively coupled plasma (CCP) has been demonstrated by the inventors as being useful for atomic absorption spectrometry (AAS), atomic emission spectrometry (AES) and gas chromatography (GC). The design provides for very effective energy transfer from the power supply to the plasma by capacitive coupling. In this way, the plasma can be generated at atmospheric pressure and in a flexible geometry. The plasma can be operated over a wide range of rf input powers (10-600 W) which allows for optimal conditions for atom resonance line absorption and emission measurements.

The discharge can be formed in a long quartz tube (20 cm in length) and runs at low support gas flow rates (0.05 L/min) both of which provide for a relatively long residence time of analyte atoms.

Originally, sample introduction into this plasma was accomplished by using an electrically heated tantalum strip vaporizer, see Dong C. Liang and M. W. Blades, Anal. Chem. 60, 27 (1988). The analyte atoms vaporized from the tantalum strip were carried by the plasma gas into the plasma through a quartz capillary. In this case, the transport efficiency is determined by the flow rate of the plasma gas. The greater the gas flow rate, the higher the transport efficiency, but the shorter the residence time of analyte atoms in the plasma.

In order to increase the transport efficiency and residence time, we have invented an atmospheric pressure furnace capacitively coupled plasma (APF-CCP). This device combines the advantages of a graphite furnace at atmospheric pressure with those of the CCP. The electrode arrangement in the APF-CCP is similar to that described by J. M. Harnley, D. L. Styris and N. E. Ballou, Abstracts, the Pittsburg Conference & Exposition, Paper No. 847 (1989). However, the plasma is formed between the graphite tube and a central electrode by rf capacitive coupling at atmospheric pressure. This is in contrast to the plasma described by Harnley et. al. which is a low pressure, dc glow discharge. With the APF-CCP of the invention, conventional, thermal, graphite tube atomization is still possible but atmospheric pressure rf sputtering can also act as an atomization mechanism. Our device provides a new dimension to the use of graphite furnaces for analytical atomic spectroscopy.

Figure 1:
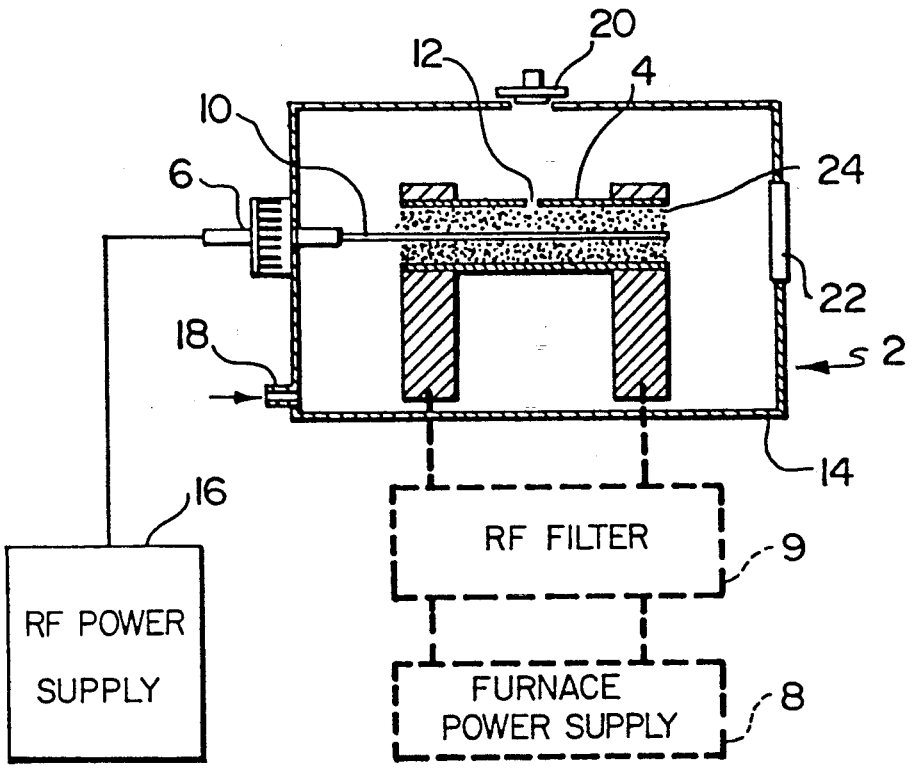

A schematic diagram of our APF-CCP device is illustrated in the FIG. 1. The concept of the APF-CC design is to combine the high efficiency of atomization in an electro-thermal atomizer with the high efficiency of excitation in plasmas. Functionally, the APF-CCP source 2 consists of an electro-thermal atomizer 4 (the furnace tube) and an rf discharge 6 (the CCP). The furnace tube 4 can be graphite type or metal type, and optionally is heated using a conventional graphite furnace atomizer power supply 8 and RF filter 9 (both shown in broken lines as they are optional). The function of the furnace tube 4 in this source is to act mainly as a vaporization device. This is different from its role in GFAAS in which the graphite acts as a reducing reagent to generate free atoms. For this reason the metal furnace has the definite advantage of preventing the formation of metal carbides.

To form a plasma inside the furnace tube 4, a 1 mm diameter thoriated-tungsten (graphite could also be used) rod 10 was inserted along the center axis of the graphite furnace. The furnace tube 4 and rod 10 are housed in a chamber 14. Chamber 14 has a plasma gas inlet 18, a sample hole 20 on the top and a quartz window 22 for viewing. The rf power supply 16 was connected through an impedance matcher (not shown) between the graphite furnace 4 and the central electrode 10. While solid and liquid samples can be placed on the inner surface of the furnace tube through hole 12, liquid samples can also be placed on the central rod 10 (on which 5 μl liquid can be held). This later arrangement is similar to the STPF and provides an isothermal condition for atomization.

The equipment and experimental set-up employed in this development are tabulated in Table 1.

TABLE 1

| Experimental Facilities and Operating Conditions | |
|---|---|
| Plasma Power Supply | Power Amplifier: Ehrhorn (Canon, CO), Model Alpha 86 hf<br>Amateur Linear Power Amplifier<br>Oscillator: modified Heathkit (Benton Harbor, MI), Model DX-60<br>Phone and CW Transmitter. Working frequency - 27 MHz<br>Impedance matching: Wm. M. Nye (Bellevue, WA), Model MB-V-A Antenna Tuner. |
| Graphite Furnace | Modified Instrumentation Laboratory (Wilmington, MA), Model 455 flameless Atomizer. |
| Spectrometer | Varian (Springvale, Australia), Model AA-875 Atomic Absorption Spectrophotometer operating in emission mode, integrate repeat 0.1 sec., fast recorder mode. |
| Band width | 0.05 nm for spectra scans and 0.2 nm for intensity measurements. |
| Data Acquisition | Servocorder 210 chart recorder, 1 volt/full scale, 3 cm/min. |

Spectra from the APF-CCP 2 were obtained by placing a small solid piece of brass (about 5 mg) into the furnace 4 through the furnace sample introduction port 20. The plasma was ignited and the graphite tube 4 was heated to a suitable temperature to provide atomic vapor from the solid sample (approximately 800° C.) and spectra were recorded. For quantitative intensity measurements, the plasma was first turned on, the graphite tube 4 was heated using a programmed heating cycle and the emission signal at the vaporization step was recorded. Liquid samples (2-5 μl) were injected onto the central rod 10 using a 0.5-10 μl Eppendorf ultra-micro digital pipette. Conventional dry, ash and vaporization stages were applied to the sample.

The plasma 24 (see FIG. 1) forms inside the furnace 4 as soon as rf power from the rf power supply 16 is applied. We have found that a Tesla coil is not required for ignition. If one is using an rf generator without an auto-matching network, the plasma 24 can be ignited from thermionic emission during the vaporization step when the matching network is initially tuned for the plasma running position. When the plasma 24 is ignited, the colour of the tungsten rod 10 is dark or dark-red at low rf powers. In that case atmospheric pressure rf sputtering is the dominant sampling mechanism. With an increase in rf power, and/or heating up the furnace tube 4 by application of dc current, the colour of the central rod 10 changes from orange to white-hot. Under this condition sampling takes place by both rf sputtering and by conventional thermal vaporization.

Figure 2A:
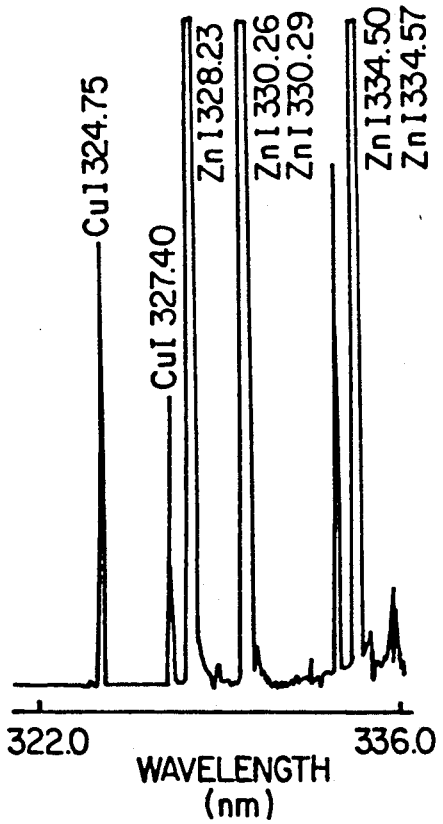
Figure 2B:
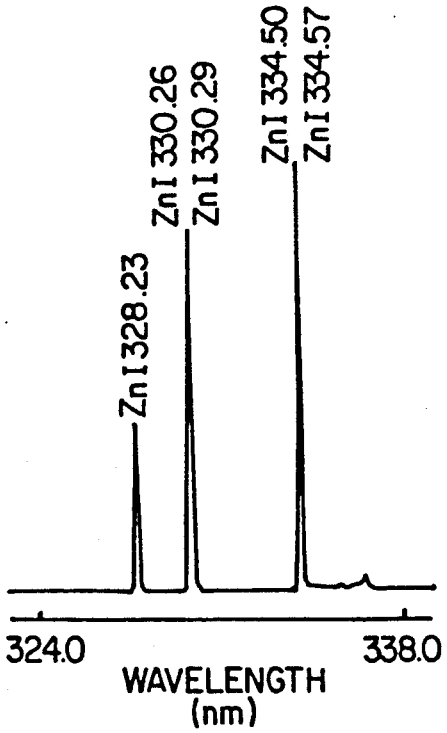

Typical emission spectra is shown in FIG. 2. FIG. 2(*a*) was recorded at a higher gain setting relative to the gain in FIG. 2(*b*). The spectra were obtained by placing a small brass chip (about 5 mg) on the inside of the graphite tube. The rf power was set to 20 W and the argon flow was 0.94 L/m. The spectra cover a range from 322 nm to 338 nm. The concentrations of zinc and copper in the brass are approximately 30–35% and 65–70% respectively. As can be seen from FIG. 2(*a*), the intensities of Zn I 334.50, 330.26, 328.23 nm lines with excitation energies of 7.78 ev are efficiently excited as are the Cu I 324.75 and 327.40 nm lines (excitation potentials are 3.82 ev and 3.78 ev respectively). The higher emission intensity for Zn relative to Cu can be explained on the basis of the boiling points of these metals which are 907° C. and 2595° C. respectively.

Figure 3:
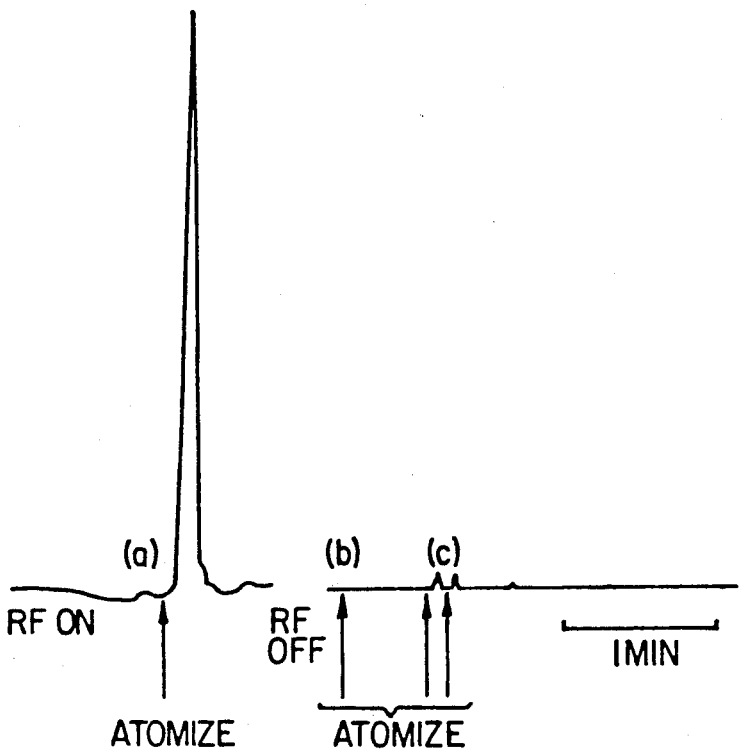

To evaluate the effect of the CCP inside the graphite furnace on the emission intensity, the intensity of Zn I 334.50 nm was measured from the APF-CCP, i.e. plasma, on the dark red furnace temperature (approximately 800° C.). The signal is shown in FIG. 3(*a*) and was very strong. No signal was found if the plasma was off at the same furnace temperature (FIG. 3*b*). When the furnace temperature was increased to its maximum (2700°–3000° K.) a small pure furnace emission (CFAES) signal was observed (FIG. 3*c*). The results shown in FIG. 3 show that the plasma formed inside the furnace acts to excite atomic species in the gas phase.

In order to test the precision of this source, replicate signal acquisitions of the Cu I 324.75 nm emission intensity were acquired. The signals were obtained using a 1 s. integration time and plotting the signals using a bar chart record mode. The intensities were set at the middle of the dynamic range (full scale = 100). The average of thirteen signals was 54.4 with a relative standard deviation of 1.9%.

Figure 4:
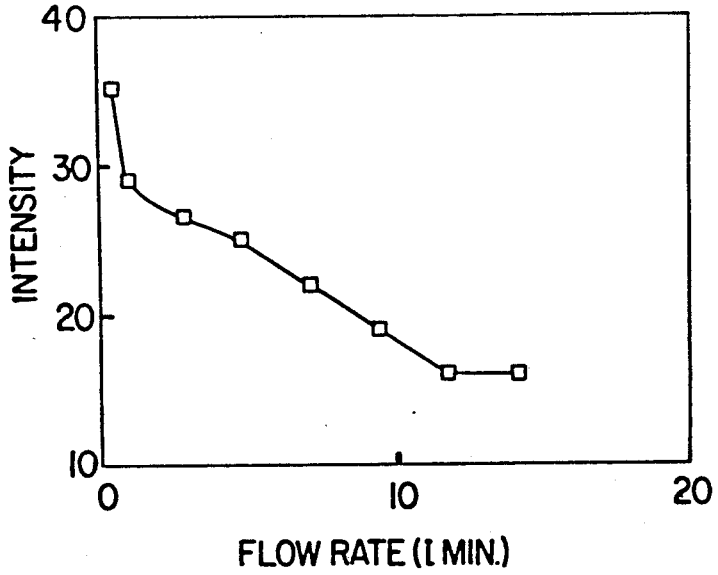

Although the plasma gas does not flow directly through the furnace itself, an increase in the plasma flow rate will decrease the residence time of analyte atoms in the furnace, and consequently reduce the emission intensity. This result has been observed by measuring the effect of argon flow rate on the intensity of the Cu I 324.75 nm line. The results are graphically illustrated in FIG. 4.

An atmospheric pressure plasma sustained inside a graphite tube has been described. This source combines the high efficiency of atomization in furnaces and the high efficiency of the excitation in atmospheric pressure plasmas. Atmospheric pressure operation is not only convenient for changing samples but also provides for the possibility of high-yield rf sputtering. Atmospheric pressure plasmas provide a relatively high thermal gas temperature which should allow more complete dissociation of molecular species. This should reduce the occurrence of gas phase chemical interferences inside the furnace. This source offers the ability to independently optimize vaporization and excitation. However, the most important aspect of this new source is that it can be used for simultaneous, multielement determinations of small sample sizes in an atomizer which has been proven to be effective over many years of use.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A capacitively coupled atmospheric pressure plasma sustaining apparatus comprising:

(a) an electrically conducting, hollow tube;

(b) an electrically conducting rod located co-axially and substantially inside the tube forming a capacitively coupled annular space between the rod and hollow tube;

(c) means for enabling an ionizable gas to be present at about atmospheric pressure in the annular space between the hollow tube and the rod; and (d) means for applying a high frequency electric potential between the hollow tube and the rod to sustain a capacitively coupled plasma in the ionizable gas in the annular space at about atmospheric pressure.

2. An apparatus as claimed in claim 1 wherein the tube is constructed of graphite or metal.

3. An apparatus as claimed in claim 2 wherein the tube is graphite and is heated by a power supply.

4. An apparatus as claimed in claim 1 wherein the rod is a radio frequency electrode, which derives power from a radio frequency power supply.

5. An apparatus as claimed in claim 4 wherein an impedance matcher connects the radio frequency power supply and the radio frequency electrode.

6. An apparatus as claimed in claim 1 wherein the tube is operated by a power supply which is connected to the tube by a radio frequency filter.

7. An apparatus as claimed in claim 4 wherein the tube is a graphite tube and the radio frequency electrode is a graphite rod inserted into the interior of the graphite tube.

8. An apparatus as claimed in claim 4 wherein the tube is a graphite tube and the radio frequency electrode is a tungsten rod inserted into the interior of the graphite tube.

9. An apparatus as claimed in claim 4 wherein the radio frequency power supply is operated at between about 10 and 600 watts.

10. An apparatus as claimed in claim 1 wherein the high frequency electric potential between the tube and the rod ionizes the ionizable gas to form a plasma between the tube and the rod.

11. An apparatus as claimed in claim 1 wherein the tube is an elongated hollow cylinder.

12. An apparatus as claimed in claim 1 further including means for enabling a liquid, solid or gas sample to be introduced into the interior of the hollow tube.

13. An apparatus as claimed in claim 12 further including means for heating the hollow tube.

14. A method of igniting and sustaining an atmospheric pressure radio frequency capacitively coupled plasma which comprises the steps of placing an ionizable gas at atmospheric pressure between a hollow electrically conducting cylindrical tube and an electrically conducting rod located co-axially and substantially inside the cylindrical tube, and applying a high frequency electric potential between the cylindrical tube and the rod to ignite and sustain a capacitively coupled plasma in the ionizable gas at about atmospheric pressure.

15. A method as claimed in claim 14 wherein a liquid, solid or gas sample is introduced into the interior of the cylindrical tube and wherein the method further comprises the steps of heating the tube by passing an electrical current through the tube to vaporize the sample, and conducting chemical analysis on the vaporized sample.

16. A method as claimed in claim 15 wherein the ionizable gas is argon.

17. A radio frequency plasma device comprising:

(a) a conductive hollow electrode open to atmosphere;

(b) a conductive rod extending substantially axially within at least a portion of the hollow electrode;

(c) means for capacitively coupling an R.F. generator between the hollow electrode and the conductive rod so as to generate an R.F. field in an interior of the hollow electrode; and (d) means for delivering to the interior of the hollow electrode an ionizable gas at about atmospheric pressure for generating a plasma within the electrode, wherein a capacitively coupled plasma in the ionizable gas is sustained in the interior of the hollow electrode at about atmospheric pressure.

18. A plasma device according to claim 17 wherein the hollow electrode is tubular.

19. A plasma device according to claim 18 wherein the hollow electrode and the conductive rod are housed in an enclosure.

20. A plasma device according to claim 19 wherein the enclosure has an inlet for admitting plasma gas.

21. A plasma device according to claim 20 wherein the enclosure has an opening through which a sample can be introduced into the interior of the tubular electrode.

22. A radio frequency plasma device comprising:

(a) an enclosure;

(b) a conductive hollow electrode open to atmosphere housed within the enclosure;

(c) a conductive rod extending substantially within at least a portion of the hollow electrode;

(d) means for capacitively coupling an R.F. generator directly between the hollow electrode and the conductive rod so as to generate an R.F. field in an interior of the hollow electrode; and (e) means for delivering to the interior of the hollow electrode an ionizable gas at about atmospheric pressure for generating a plasma within the hollow electrode, wherein a capacitively coupled plasma in the ionizable gas is sustained in the interior of the hollow electrode at about atmospheric pressure.

23. A radio frequency plasma sustaining device comprising:

(a) a housing forming a chamber;

(b) a conductive hollow electrode furnace tube to be disposed in the chamber and having a central axis, the tube being open at its ends and having a hole formed in its circumference for insertion of liquid samples;

(c) a conductive rod comprising one of thoriated-tungsten and graphite disposed at least substantially in the hollow furnace tube along the central axis thereof;

(d) means for capacitively coupling an R.F. generator directly between the hollow furnace tube and the conductive rod so as to generate an R.F. field in an interior of the hollow furnace tube, the means comprising an R.F. power supply and an R.F. discharge device electrically coupled to the conductive rod, the means further comprising a graphite furnace atomizer power supply, and an R.F. filter coupled to the furnace atomizer power supply and electrically connected to the hollow furnace tube; and (e) means for delivering to the interior of the hollow furnace tube an ionizable gas at about atmospheric pressure for generating a plasma within the hollow furnace tube, wherein a capacitively coupled plasma in the ionizable gas is sustained in the interior of the hollow electrode at about atmospheric pressure, wherein the housing has an inlet for admitting plasma gas, an opening for introducing the samples into the hole of the hollow furnace tube, and a window for viewing the hollow furnace tube.

24. A plasma sustaining device according to claim 23, wherein the hollow furnace tube and the conductive rod comprise graphite.

* * * * *